US007693480B2

(12) United States Patent
Nomura et al.

(10) Patent No.: US 7,693,480 B2
(45) Date of Patent: Apr. 6, 2010

(54) SHEET POST-PROCESSING APPARATUS, AND IMAGE FORMING SYSTEM INCLUDING THE SAME

(75) Inventors: Tomoichi Nomura, Aichi (JP); Masahiro Tamura, Tokyo (JP); Nobuyoshi Suzuki, Tokyo (JP); Shuuya Nagasako, Ebina (JP); Kazuhiro Kobayashi, Kawasaki (JP); Shohichi Satoh, Yokohama (JP); Akira Kunieda, Tokyo (JP); Hiroshi Maeda, Aichi (JP)

(73) Assignee: Ricoh Co., Ltd., Tokyo (JP)

( * ) Notice: Subject to any disclaimer, the term of this patent is extended or adjusted under 35 U.S.C. 154(b) by 566 days.

(21) Appl. No.: 11/639,415

(22) Filed: Dec. 15, 2006

(65) Prior Publication Data

US 2007/0147925 A1 Jun. 28, 2007

(30) Foreign Application Priority Data

Dec. 16, 2005 (JP) ..... 2005-363655

(51) Int. Cl.
*G03G 15/00* (2006.01)

(52) U.S. Cl. ..... 399/410; 399/408

(58) Field of Classification Search ..... 399/407, 399/408, 410; 400/405

See application file for complete search history.

(56) References Cited

U.S. PATENT DOCUMENTS

| | | | | |
|---|---|---|---|---|
| 6,145,825 | A * | 11/2000 | Kunihiro et al. | 270/58.09 |
| 6,712,349 | B2 * | 3/2004 | Watanabe | 270/37 |
| 6,871,851 | B2 | 3/2005 | Tamura et al. | |
| 6,889,974 | B2 | 5/2005 | Tamura et al. | |
| 2006/0153612 | A1 * | 7/2006 | Saitsu et al. | 399/410 |

FOREIGN PATENT DOCUMENTS

| | | |
|---|---|---|
| JP | 11-130338 | 5/1999 |

* cited by examiner

*Primary Examiner*—Judy Nguyen
*Assistant Examiner*—Allister Primo
(74) *Attorney, Agent, or Firm*—Harness, Dickey & Pierce, P.L.C.

(57) ABSTRACT

A sheet post-processing apparatus, e.g., that is included in an image forming system, includes: a sheet stacking unit configured to stack a plurality of sheets of one or more printable media; a sheet alignment unit configured to align the plurality of sheets stacked in the sheet stacking unit; a pressing mechanism configured to press and hold the plurality of sheets stacked in the sheet stacking unit; and a stapling unit configured to staple the plurality of sheets aligned by the sheet alignment unit, the stapling unit being displaceable to a given position that avoids interference with the pressing mechanism while the sheet alignment unit performs a sheet alignment with respect to the plurality of sheets in the sheet stacking unit.

21 Claims, 9 Drawing Sheets

SHEET POST-PROCESSING APPARATUS, AND IMAGE FORMING SYSTEM INCLUDING THE SAME

PRIORITY STATEMENT

The present patent application claims priority under 35 U.S.C. §119 upon Japanese patent application no. 2005-363655, filed in the Japan Patent Office on Dec. 16, 2005, the content and disclosure of which is hereby incorporated by reference herein in its entirety.

DISCUSSION OF THE RELATED ART

Related art sheet post-processing apparatuses have handled paper sheets by performing operations of alignment, staple, and so forth. Various techniques have been used for the related sheet post-processing apparatus.

A related art sheet post-processing apparatus has employed one of the techniques, which includes the following features.

A discharging roller is provided in the vicinity of a staple tray, and a rear end fence is disposed at a rear end of the staple tray.

A regulation press member that reciprocates in a sheet pressing direction is provided below the discharging roller and in the vicinity of the vicinity of the rear end fence.

The regulation press member has a sheet regulation press surface on its leading end, and a sheet guide surface is mounted on an upper portion of the sheet regulation surface.

The regulation press member is located at a first regulation position near the staple tray when the number of stacked paper sheets is small, at a second regulation position when the number of the stacked paper sheets is medium, and at a third regulation position when the number of the stacked sheets is large.

After a paper sheet is guided to the rear end fence by the inclined sheet guide surface and the sheet regulation press surface, the paper sheet is pressed by advancing the regulation press member.

While a stack of paper sheets is being aligned for a stapling operation in the above-described related art sheet post-processing apparatus, a stapling unit provided therein generally stands by at its stapling position. In this condition, the stapling unit covers the edge of the stack of paper sheets and the regulation press member cannot press the edge of the stack of paper sheets in the staple tray.

Further, a sheet rear end pressing member provided in the above-described related art sheet post-processing apparatus has not had a structure to press both rear ends of the stack of paper sheets, not even to press an area in the vicinity of the stapling unit. The sheet rear end pressing member also has not been adjusted to each size of various paper sheets.

SUMMARY

At least one embodiment of the present invention has been made, taking the above-mentioned circumstances into consideration.

At least one embodiment of the present invention provides a sheet post-processing apparatus that includes: a sheet stacking unit configured to stack a plurality of sheets of one or more printable media; a sheet alignment unit configured to align the plurality of sheets stacked in the sheet stacking unit; a pressing mechanism configured to press and hold the plurality of sheets stacked in the sheet stacking unit; and a stapling unit configured to staple the plurality of sheets aligned by the sheet alignment unit, the stapling unit being displaceable to a given position that avoids interference with the pressing mechanism while the sheet alignment unit performs a sheet alignment with respect to the plurality of sheets in the sheet stacking unit.

At least one embodiment of the present invention provides a sheet post-processing apparatus that includes: a sheet stacking unit configured to stack a plurality of sheets of one or more printable media; a sheet alignment unit configured to align the plurality of sheets stacked in the sheet stacking unit; a first pressing mechanism configured to press and hold the plurality of sheets stacked in the sheet stacking unit; a stapling unit configured to staple the plurality of sheets aligned by the sheet alignment unit; and a second pressing mechanism different from the first pressing mechanism and mounted on the stapling unit.

At least one embodiment of the present invention provides an image forming system that includes: an image forming apparatus configured to form an image on a surface of a recording medium; and a sheet post-processing apparatus connected to the image forming apparatus: The sheet post-processing apparatus includes: a sheet stacking unit configured to stack a plurality of sheets; a sheet alignment unit configured to align the plurality of sheets stacked in the sheet stacking unit; a first pressing mechanism configured to press and hold the plurality of sheets stacked in the sheet stacking unit; and a stapling unit configured to staple the plurality of sheets aligned by the sheet alignment unit, the stapling unit being displaceable to a given position that avoids interference with the first pressing mechanism while the sheet alignment unit performs a sheet alignment with respect to the plurality of sheets in the sheet stacking unit.

Additional features and advantages of the present invention will be more fully apparent from the following detailed description of example embodiments, the accompanying drawings and the associated claims.

BRIEF DESCRIPTION OF THE DRAWINGS

The accompanying drawings are intended to depict example embodiments of the present invention and should not be interpreted to limit the scope thereof. The accompanying drawings are not to be considered as drawn to scale unless explicitly noted.

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE EXAMPLE EMBODIMENTS

Figure 1:
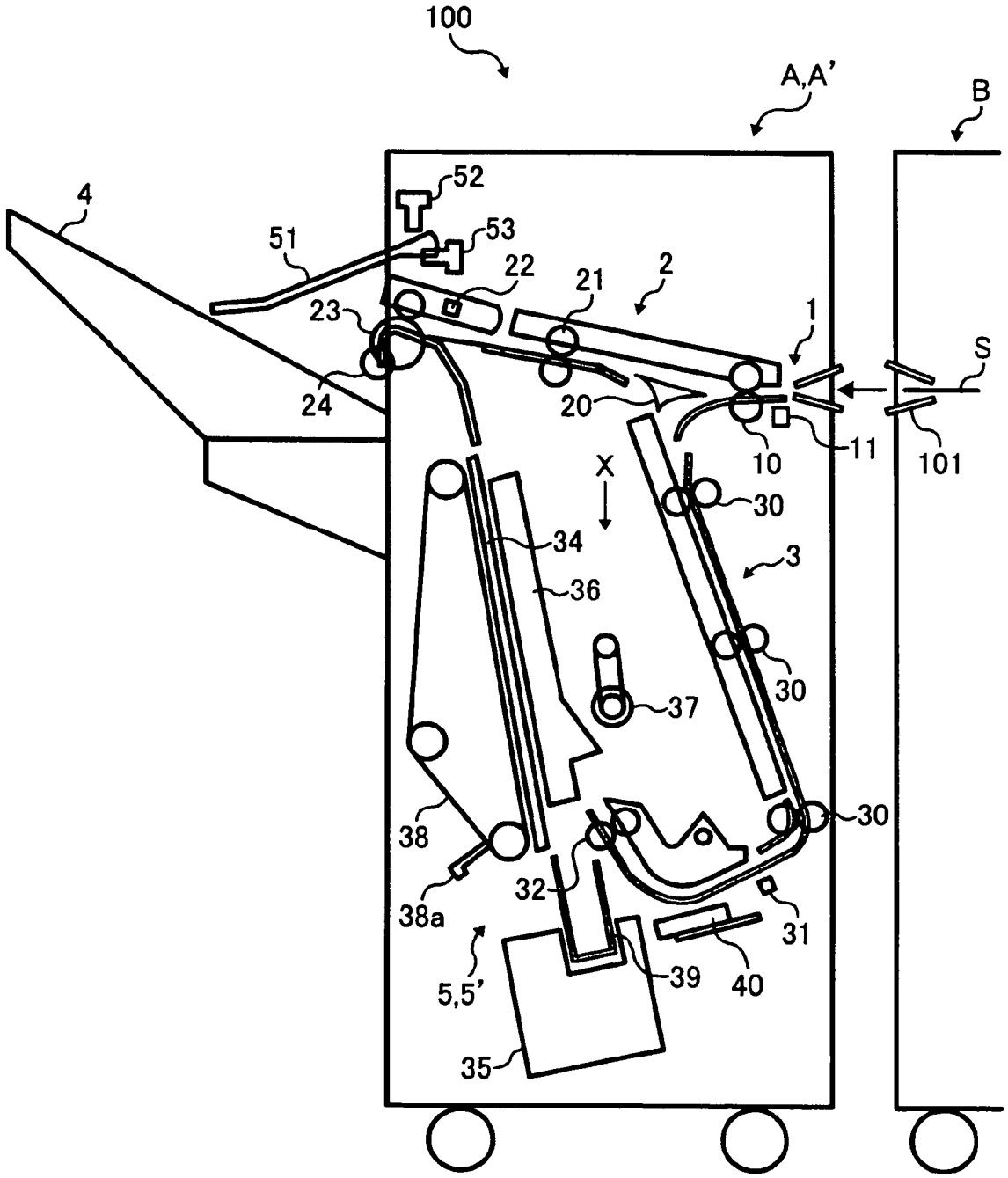
FIG. 1 is a schematic structure of an image forming system including a sheet post-processing apparatus according to at least one example embodiment of the present invention.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would hen be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, example embodiments of the present invention are described.

Referring to FIG. 1, a schematic structure of an image forming system 100 according to one example embodiment of the present invention.

The image forming system 100 includes a sheet post-processing apparatus A and an image forming apparatus B.

The image forming apparatus B of the image forming system 100 may form an image on a surface of a sheet S of a printable medium, e.g., paper. Typically, but not necessarily, the medium is paper. Other printable media is available in sheets and their use here is included. For simplicity, the remaining description refers to paper sheets. It should be understood, however, that the sheets are not limited only to being paper. The image forming apparatus B may convey the paper sheet S via the sheet outlet portion to the sheet post-processing apparatus A. The image forming apparatus B includes a sheet outlet portion 101 from which a paper sheet S that serves as a recording medium may be discharged.

The sheet post-processing apparatus A is connected to the image forming apparatus B and includes a sheet inlet path 1 to which the paper sheet S is conveyed from the sheet outlet portion 101 of the image forming apparatus B.

The sheet inlet path 1 includes a pair of inlet rollers 10, an inlet sensor 11, and a path separator 20.

When the paper sheet S is conveyed from the sheet outlet portion 100, the inlet sensor 11 may detect the paper sheet S and the pair of inlet rollers 10 may convey the paper sheet S toward the path separator 20.

One end of the path separator 20 may be swingablly disposed, and the other end may be arranged in the vicinity of the sheet outlet portion 100 of the image forming apparatus B.

The path separator 20 may guide the paper sheet S to one of two sheet conveying paths.

The two sheet conveying paths may branch from the sheet inlet path 1 and include an upper sheet conveying path 2, and a lower sheet conveying path 3.

The upper sheet conveying path 2 may guide the paper sheet S to a sheet discharging tray 4. The lower sheet conveying path 3 may guide the paper sheet S to a staple unit 5 in which a stapling operation is performed to staple paper sheets stacked therein together.

When the image forming apparatus B of the image forming system 100 starts an image forming operation, the sheet discharging tray 4 is elevated up to a given height. When a plurality of the paper sheets S are stacked on the sheet discharging tray 4 up to a height of "full of paper sheets" or a paper sheet full state, a controller (not shown) may cause the image forming apparatus B to stop the image forming operation.

The upper sheet conveying path 2 may include a pair of sheet conveying rollers 21, an outlet sensor 22, a pair of sheet discharging rollers 23, a guide roller 24, a filler 51, and upper and lower sheet surface detection sensors 52 and 53.

The pair of sheet conveying rollers 21 may convey the paper sheet S into the upper sheet conveying path 2.

The outlet sensor 22 is disposed in the vicinity of the pair of sheet discharging rollers 23. The outlet sensor 22 may detect the paper sheet S when the paper sheet S passes a given position.

The paper sheet S may be then discharged by the pair of sheet discharging rollers 23 and be guided by the guide roller 24 to the sheet discharging tray 4 so that the paper sheet S can be sequentially stacked into the sheet discharging tray 4.

The filler 51 may be disposed in the vicinity of and above the pair of sheet discharging rollers 23. One end or a movably attached end of the filler 51 may be swingablly disposed above the pair of sheet discharging rollers 23. The other end or a free end of the filler 51 may be arranged to contact a top surface of the paper sheet S at its center area with respect to a sheet conveying direction of the paper sheet S when the paper sheet S is conveyed to the sheet discharging tray 4.

The upper and lower sheet surface detection sensors 52 and 53 may detect a position of the free end of the filler 51, so as to detect the height of the stack of paper sheet.

The upper and lower sheet surface detection sensors 52 and 53 may be disposed in the vicinity of the movably attached end of the filler 51, which is opposite to the free end thereof, and may sandwich the pivoted end of the filler 51 therebetween.

When the movably attached end of the filler 51 is located at a substantially center portion between the upper and lower sheet surface detection sensors 52 and 53, the upper and lower sheet surface detection sensors 52 and 53 may remain in an undetected state.

As previously described, the sheet discharging tray 4 may be elevated to the given height when the image forming apparatus B of the image forming system 100 starts the image forming operation. At this time, the movably attached end of the filler 51 may move closer to the lower sheet surface detection sensor 53. This may once turn on the lower sheet surface detection sensor 53. That is, the state of the lower sheet surface detection sensor 53 may change from the undetected state to a detected state.

The sheet discharging tray 4 may then move down to adjust its position for receiving the paper sheet S to be discharged. This action of the sheet discharging tray 4 may turn off the lower sheet surface detection sensor 53. That is, the state of the lower sheet surface detection sensor 53 may change from the detected state to the undetected state. The position of the sheet discharging tray 4 corresponding to the timing at which the lower sheet surface detection sensor 53 turns off in the above-described operation may be set as a home position thereof for performing a regular sheet processing operation.

Along with an increase of the number or height of paper sheets S output on the sheet discharging tray 4, the lower sheet surface detection sensor 53 may turn on or may change to the detected state. On changing the state of the lower sheet surface detection sensor 53 to the detected state, a controller (not shown) of the sheet post-processing apparatus A may cause a drive unit (not shown) to move the sheet discharging tray 4 to a downward direction. The drive unit may move the sheet discharging tray 4 in a vertical direction according to instructions from the controller.

After the sheet discharging tray 4 has been moved to a given downward position and the lower sheet surface detection sensor 53 has been turned off or has been changed to the undetected state, the controller of the sheet post-processing apparatus A may cause the drive unit to stop the movement of the sheet discharging tray 4.

The controller may repeatedly cause the drive unit to adjust the position of the sheet discharging tray 4 until the height of the paper sheets S on the sheet discharging tray 4 reaches a given height indicating the paper sheet full state. When the paper sheet full state is detected in the image forming system 100, the sheet post-processing apparatus A may send the image forming apparatus B a signal to stop the image forming operation performed by the image forming apparatus B.

The lower sheet conveying path 3 includes pairs of sheet conveying rollers 30, an outlet sensor 31, and a pair of outlet rollers 32.

The pairs of sheet conveying rollers 30 may sequentially convey the paper sheet S in the lower sheet conveying path 3, the paper sheet S.

The outlet sensor 31 is disposed in the vicinity of the lowest one of the pairs of sheet conveying rollers 30. The outlet sensor 31 may detect the paper sheet S when the paper sheet S passes a given position near the outlet sensor 31.

The paper sheet S may be then discharged by the pair of sheet outlet rollers 32 to the staple unit 5 disposed in the vicinity of an exit of the pair of outlet rollers 32.

The staple unit 5 includes a staple tray 34, a stapler 35, jogger fences 36, a return roller 37, a discharge belt 38, a hook 38*a*, a rear end fence 39, and a rear end holding mechanism 40.

The staple tray 34 may serve as a sheet stacking unit and may receive and stack the paper sheet S therein.

The stapler 35 is disposed below the rear end fence 39 and may staple a plurality of the paper sheets S stacked and aligned in the staple tray 34. The stapler 35 may move in a width direction of the paper sheet S so as to perform a stapling operation. The "width direction" in at least one example embodiment of the present invention represents a direction parallel to a bottom of the sheet post-processing apparatus or a horizontal direction on a surface of the paper sheet S. Further, the "sheet conveying direction" described for the operations performed in the staple unit 5 in at least one example embodiment of the present invention represents a direction to which the paper sheet S is conveyed in the staple unit 5 or a vertical direction on a surface of the paper sheet S.

The jogger fences 36 may serve as a sheet alignment unit and may move in the width direction of the paper sheet S so as to align the width of the plurality of the paper sheets S stacked on the staple tray 34.

The return roller 37 may serve as a sheet alignment unit and may knock the upper surface of the paper sheet S so that the paper sheet S can be aligned in the sheet conveying direction or in the vertical direction on the paper sheet S.

The discharge belt 38 may convey the stacked paper sheets S to be discharged to the sheet discharging tray 4.

The hook 38*a* is mounted on the discharge belt 38 and may support or hold a trailing end or rear end of the paper sheet S when the paper sheet S is conveyed from the staple tray 34 to the sheet discharging tray 4.

The rear end fence 39 is disposed in the vicinity of and above the stapler 35. The rear end fence 39 may serve as a sheet alignment unit and may receive and align the paper sheet S that can fall therein after the return roller 37 has aligned the paper sheet S in the sheet conveying direction.

The rear end holding mechanism 40 is disposed in the vicinity of the stapler 35 and may serve as a pressing mechanism. The rear end holding mechanism 40 may move in the direction perpendicular to the sheet conveying direction or the direction perpendicular to or toward the surface of the paper sheets S stacked in the staple tray 34 so that the rear end of the paper sheets S stacked in the staple tray 34 can be pressed and held while the stapling operation is performed.

When a staple mode signal is issued from the image forming apparatus B of the image forming system 100, the stapler 35 may move in the width direction of the paper sheet S to a given position of the rear end of a plurality of paper sheets S, and wait at a standby position. Hereinafter, the plurality of the paper sheets S stacked on the stapled tray 34 may also be referred to as a "stack of paper sheets S."

The paper sheet S that has traveled through the lower sheet conveying path 3 may be conveyed by the pair of outlet rollers 32 to the staple tray 34. The return roller 37 may knock the upper surface of the paper sheet S to fall in the rear end fence 39 to align the paper sheet S in the sheet conveying direction. Further, the jogger fences 36 may align the paper sheet S in the width direction or in the horizontal direction of the paper sheet S.

When the rear end fence 39 receives the paper sheet S therein, the rear end holding mechanism 40 may move to press and hold the paper sheet S toward the staple tray 34 so that a room for the next paper sheet S can be effectively obtained and the next paper sheet S can easily fall into the rear end fence 39.

After a given number of the paper sheets S has been stacked and aligned in the staple tray 34, the stapler 35 may move from the standby position to a stapling position so that the stack of paper sheets S may be stapled.

The stapled stack of paper sheets S may be conveyed to the sheet discharging tray 4 in a counterclockwise direction as shown in FIG. 1 while the hook 38*a* is supporting the rear end of the stack of paper sheets S. With the above-described operation, the stack of paper sheets S may be conveyed in the upward direction and may be discharged to the sheet discharging tray 4.

During the staple mode, the home position of the sheet discharging tray 4 may be set to a position in which the movably attached end of the filler 51 is located in the vicinity of the upper sheet surface detection sensor 52. That is, a position that corresponds to the timing at which the state of the upper sheet surface detection sensor 52 changes from the undetected state to the detected state.

Along with an increase of the number or height of the stack of paper sheets S output onto the sheet discharging tray 4, the upper sheet surface detection sensor 52 may turn off or may change to the undetected state. On changing the state of the upper sheet surface detection sensor 52 to the undetected state, the controller (not shown) of the sheet post-processing apparatus A may cause the drive unit (not shown) to move the sheet discharging tray 4 to the downward direction.

After the sheet discharging tray 4 has been moved to a given downward direction and the upper sheet surface detection sensor 52 has been turned on or has been changed to the detected state, the controller may cause the drive unit to stop the movement of the sheet discharging tray 4.

As previously described, the controller may repeatedly cause the drive unit to adjust the position of the sheet discharging tray 4 until the height of the paper sheets S on the sheet discharging tray 4 reaches the given height indicating the paper sheet full state. When the paper sheet full state is detected, the sheet post-processing apparatus A may send the image forming apparatus B the signal to stop the image forming operation performed by the image forming apparatus B.

Referring to FIGS. 2 through 7, detailed states and functions of the staple unit 5 including the rear end holding mechanism 40 of the sheet post-processing apparatus A according to example embodiments of the present invention are described.

FIGS. 2 through 7 are the structure of the staple unit 5 viewed from a direction indicated by arrow X in FIG. 1.

The jogger fences 36 of the staple unit 5 may include first and second jogger fences 36*a* and 36*b*.

The rear end holding mechanism 40 may include first, second, and third rear end holding members 40*a*, 40*b*, and 40*c*, a slider belt 46, and a motor 47. Each of the first, second, and third rear end holding members 40*a*, 40*b*, and 40*c* may basically have a similar structure. That is, each of the first, second, and third rear end holding members 40*a*, 40*b*, and 40*c* may include a supporting member 41, a pressing member 42, an elastically flexible member 43, a motor 44, and a motor belt 44*a*. Each of the second and third rear end holding members 40*b* and 40*c* may further include a slider 45 to be mounted thereon. Detailed functions of the above-described components will be described later.

Figure 2:
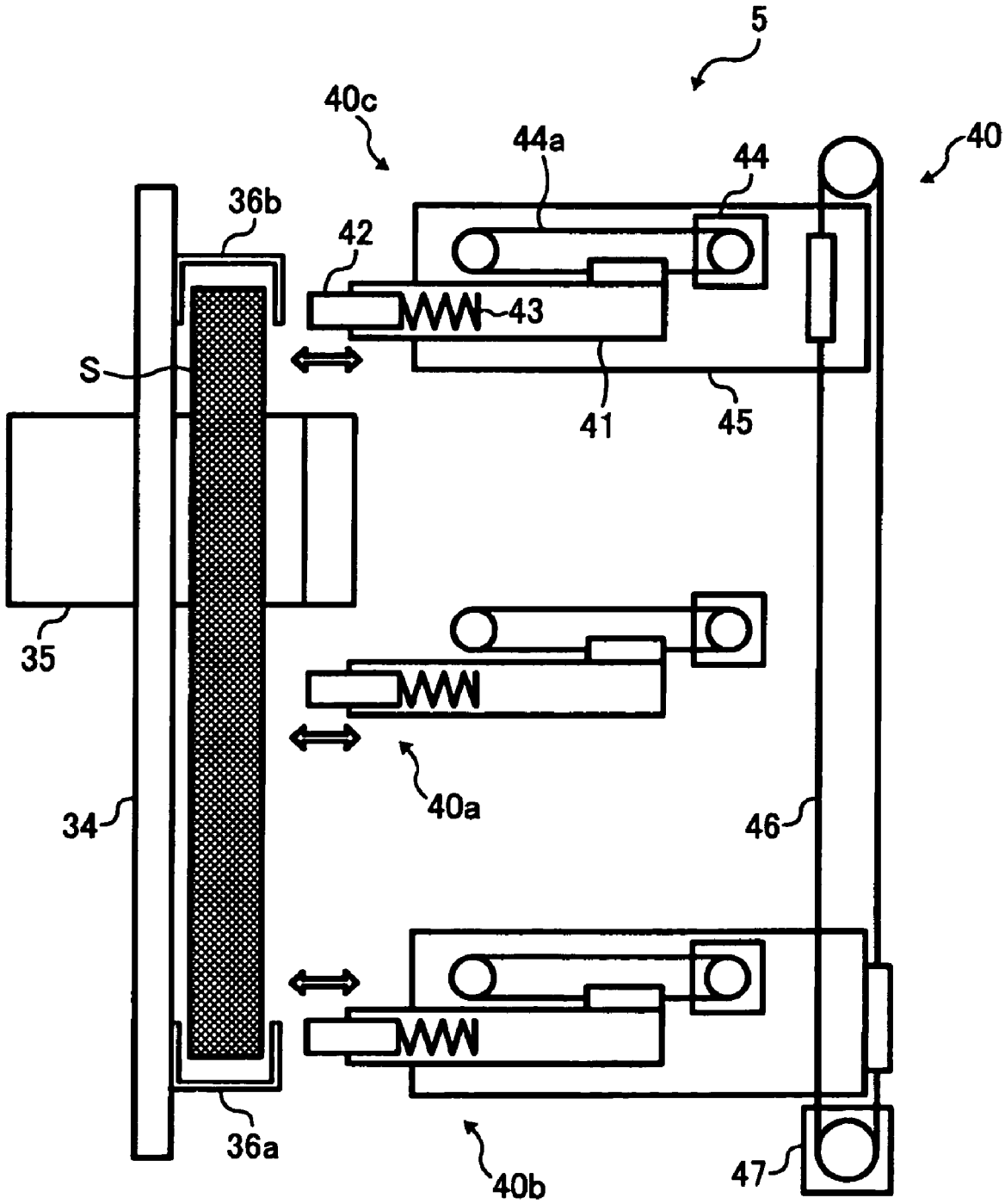
FIG. 2 is a schematic structure showing a state of a sheet alignment performed in a staple unit of the sheet post-processing apparatus according to an example embodiment of the present invention.

When the image forming apparatus B sends the staple mode signal to staple the stack of paper sheets S at its far side position, the stapler 35 and the first and second jogger fences 36*a* and 36*b* may move in the sheet width direction to a sheet receiving position and stand by at the position as shown in FIG. 2. In the staple unit 5 of the sheet post-processing apparatus A according to at least one example embodiment of the present invention, the "far side position" represents a position near the second jogger fence 36*b* on the paper sheet S or the stack of paper sheets S.

During the above-described movement of the second and third rear end holding members 40*b* and 40*c*, the stapler 35 may not be moved into the stapling position but may move to and stand by at a given position at which the stapler 35 can avoid interference with the third rear end holding member 40*c* to perform the following operation.

Each of the second and third rear end holding members 40*b* and 40*c* may be attached to a guide shaft (not shown) and the slider belt 46 via the slider 45. The belt 46 may be extended and supported by pulleys and be driven by the motor 47. Accordingly, the second and third rear end holding members 40*b* and 40*c* can move in the width direction of the paper sheet S along the slider belt 46 to correspond to a change in size of the paper sheet S conveyed to the staple tray 34. Further, the second and third rear end holding members 40*b* and 40*c* can be set to move in a range greater than the width of the paper sheet S to be conveyed to the staple tray 34.

With the above-described structure, the second and third rear end holding members 40*b* and 40*c* can move to and stand by at respective positions corresponding to the size of the paper sheet S according to information of the staple mode signal and the size of the paper sheet S.

Under the above-described condition, the paper sheet S may be aligned by the return roller 37 and the rear end fence 39 in the sheet conveying direction or the vertical direction and by the jogger fences 36*a* and 36*b* in the sheet width direction or the horizontal direction when the paper sheet S is conveyed to the staple tray 34.

During the above-described sheet alignment, the stapler 35 may stand by at the given position as previously described.

After the sheet alignment of the paper sheet S has been completed, an incorrect status of the paper sheet S, such as sheet buckling, curl, or other nonconformity caused in the process of the sheet transfer into the staple tray 34, may be corrected or adjusted so that the next paper sheet S can easily fall in the rear end fence 39.

The above-described adjusting operation may be performed by the rear end holding mechanism 40.

The motor 44 may drive the motor belt 44*a* to move the pressing member 42 in a direction perpendicular to the sheet conveying direction of the paper sheet S or the stack of paper sheets S. The pressing member 42 may be supported by the supporting member 41 and be biased by the elastically flexible member. By moving the pressing member 42 in the direction toward the paper sheet S in the direction perpendicular to the sheet conveying direction or the direction toward the paper sheet S or the stack of paper sheets S, the rear end of the paper sheet S or of the stack of paper sheets S can be pressed and held to the staple tray 34, and the next paper sheet can be smoothly conveyed to the staple tray 34 and the rear end fence 39.

When the next paper sheet S is successfully conveyed to the staple tray 34, the pressing member 42 may move away or recede from the rear end of the paper sheet S or of the stack of paper sheets S and return to the standby position, as shown in FIG. 2, so as to wait for a further subsequent paper sheet to come.

The above-described serial operations may be performed by each of the first, second, and third rear end holding members 40*a*, 40*b*, and 40*c*.

The controller of the sheet post-processing apparatus A may count the number of the plurality of the paper sheets S stacked in the staple tray 34, and may cause the motor 44 to adjust a travel distance to control a degree or amount of pressure exerted by the rear end holding mechanism 40 according to the obtained number of the plurality of the paper sheets S.

Figure 3:
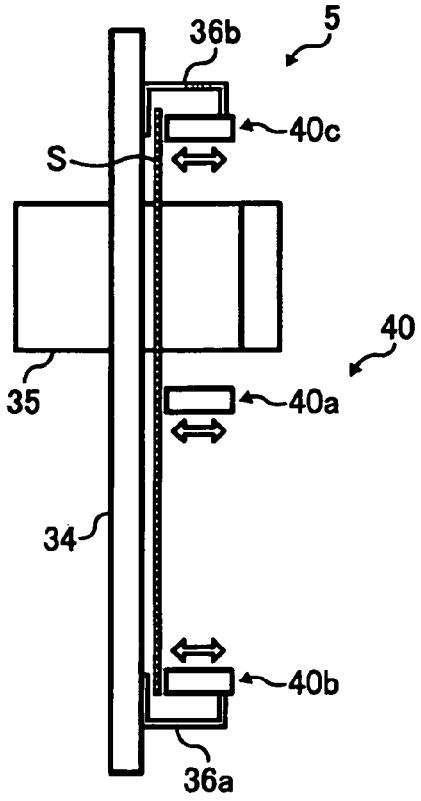
FIG. 3 is a schematic structure showing a different state of the sheet alignment performed in the staple unit of the sheet post-processing apparatus according to the example embodiment initially depicted in FIG. 2.

For example, when the number of the plurality of the paper sheets S is small and the thickness of the stack of paper sheets S is thin, as shown in FIG. 3, the controller may cause the first, second, and third rear end holding members 40*a*, 40*b*, and 40*c* to adjust the travel distance to exert an appropriate amount of pressure that may correspond to the stack of paper sheets S having the obtained number and thickness thereof.

Figure 4:
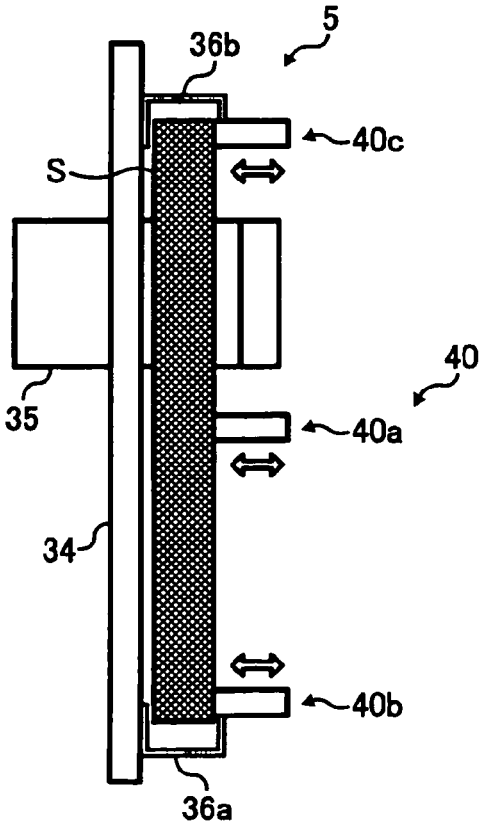
FIG. 4 is a schematic structure showing a different state of the sheet alignment performed in the staple unit of the sheet post-processing apparatus according to the example embodiment initially depicted in FIG. 2.

On the other hand, when the number of the plurality of the paper sheets S is great and the thickness of the stack of paper sheets S is thick, as shown in FIG. 4, the controller may cause the first, second, and third rear end holding members 40*a*, 40*b*, and 40*c* to adjust the travel distance to exert an appropriate amount of pressure that may correspond to the stack of paper sheets S having the obtained number and thickness thereof.

With the above-described operation, the degree or amount of pressure may be kept at a substantially constant level even when the thickness of the stack of paper sheets S or the number of the plurality of the paper sheets S varies.

Further, the thickness of a stack of thick paper sheets may become greater than the thickness of a stack of regular paper sheets. Therefore, when thick paper sheets are processed, the controller may control the degree or amount of pressure exerted by each of the first, second, and third rear end holding members 40*a*, 40*b*, and 40*c* such that an excess degree or amount of pressure may not be provided with respect to the stack of paper sheets S.

Specifically, each of the first, second, and third rear end holding members 40*a*, 40*b*, and 40*c* may have the elastically flexible member 43 mounted thereon to bias the pressing member 42. When the pressing member 42 exerts more than a desirable amount of pressure upon the stack of paper sheets S, the elastically flexible member 43 may contract (or become compressed) to absorb (or relieve) the excess amount of pressure exerted by the pressing member 42. Thereby, the pressing member 42 may recede to a direction opposite to the surface of the stack of paper sheets S and the staple tray 34.

Figure 5:
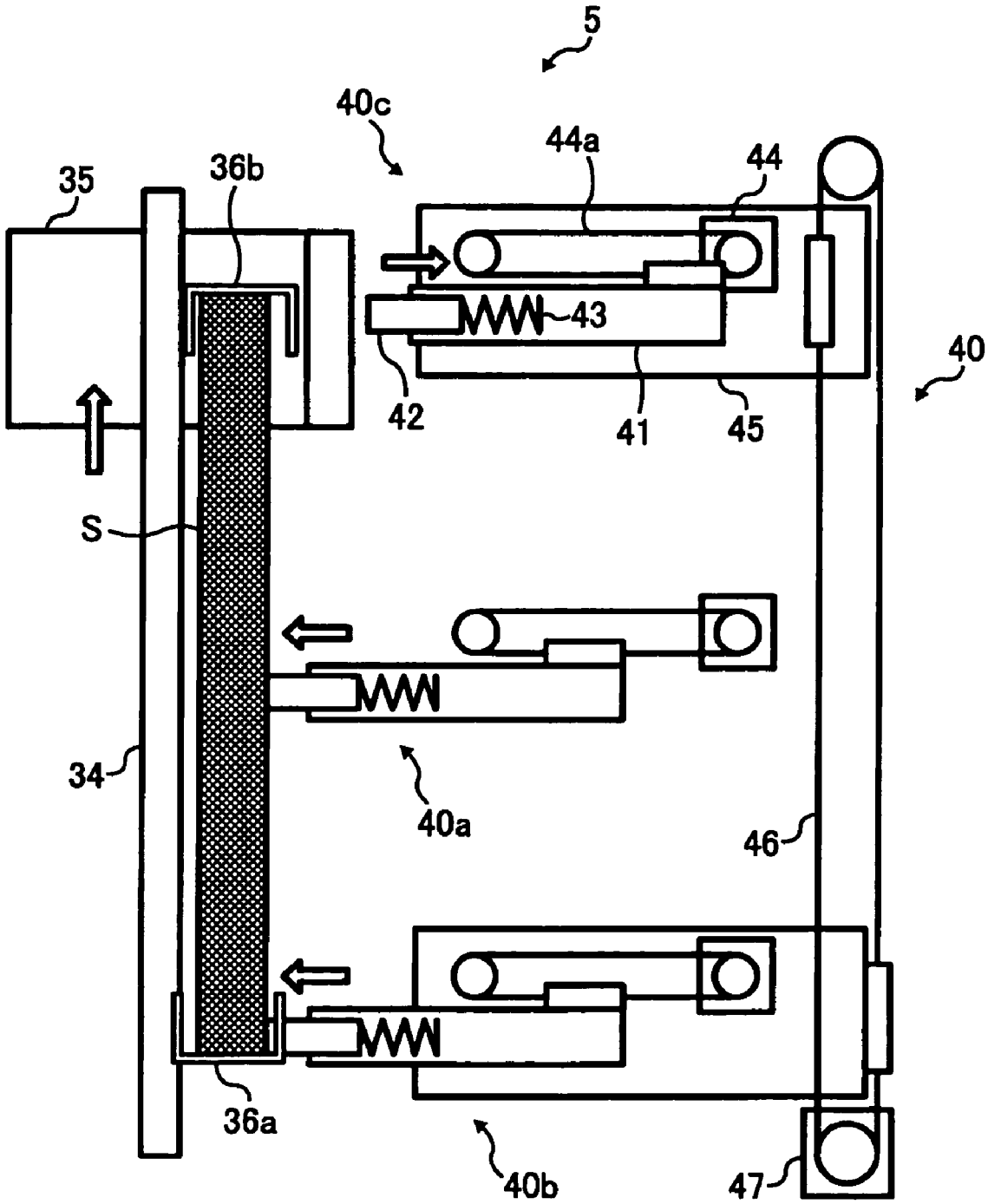
FIG. 5 is a schematic structure showing a different state of the sheet alignment performed in the staple unit of the sheet post-processing apparatus according to the example embodiment initially depicted in FIG. 2.

After the given number of the plurality of the paper sheets S have been aligned, the third rear end holding member 40*c*, which is displaceable and which is located in the vicinity of the stapler 35 at this time, may move to the direction opposite to the surface of the stack of paper sheets S and the staple tray 34, so that a situation in which the third rear end holding member 40*c* would interfere with movement of the stapler 35 can be avoided, as shown in FIG. 5. While the first and second rear end holding members 40*a* and 40*b* are pressing and holding the surface of the stack of paper sheets S, the stapler 35 may move to the stapling position to perform the stapling operation.

When the stapler 35 staples the stack of paper sheets S at a near side position, the standby position of the stapler 35 may be set to a position in the vicinity of the first jogger fence 36*a*. In the staple unit 5 of the sheet post-processing apparatus A according to at least one example embodiment of the present invention, the "near side position" represents a position in the vicinity of the first jogger fence 36*a* on the paper sheet S or the stack of paper sheets S.

Accordingly, the second rear end holding member 40*b* (which is displaceable) that is located in the vicinity of the stapler 35 this time may be moved to the direction opposite to the surface of the stack of paper sheets S and the staple tray 34 so as not to interfere with the stapler 35, and the stapler 35 may move to the stapling position to perform the stapling operation while the first and third rear end holding members 40*a* and 40*c* are pressing and holding the stack of paper sheets S.

Figure 6:
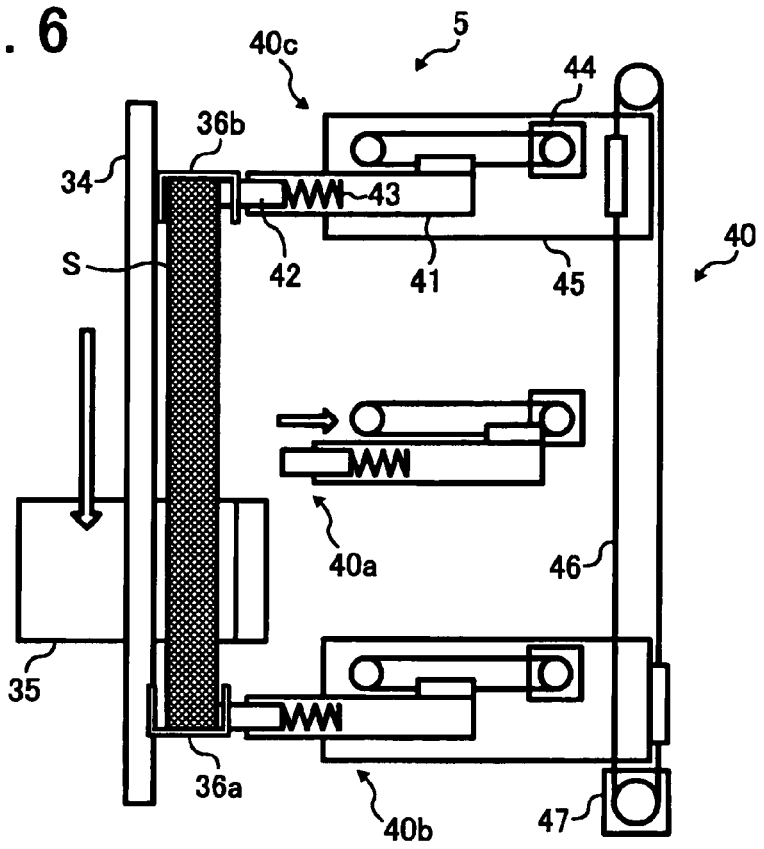
FIG. 6 is a schematic structure showing a different state of the sheet alignment performed in the staple unit of the sheet post-processing apparatus according to the example embodiment initially depicted in FIG. 2.
Figure 7:
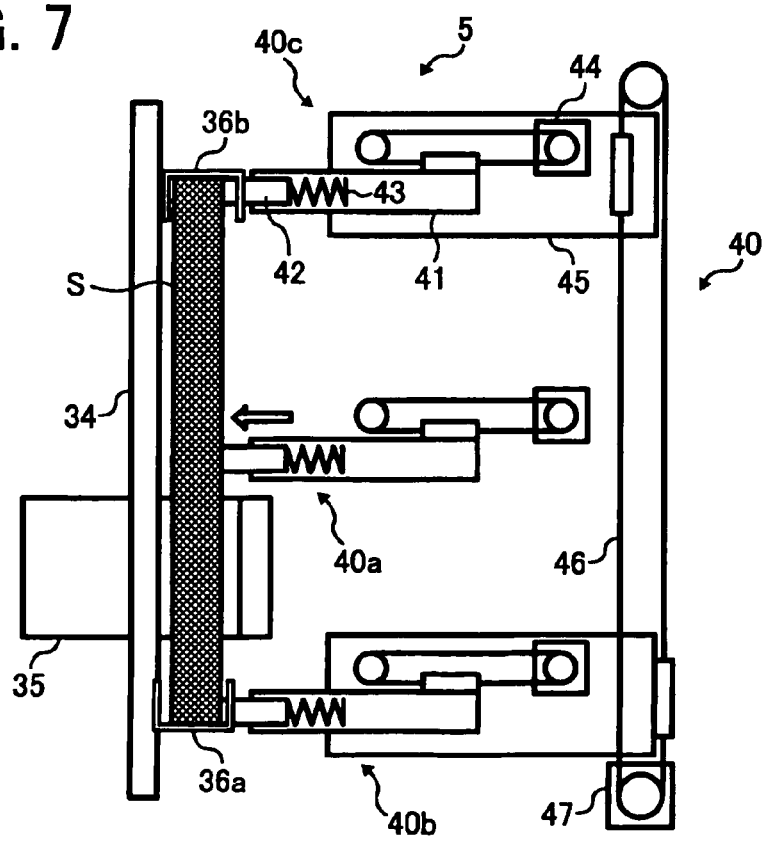
FIG. 7 is a schematic structure showing a different state of the sheet alignment performed in the staple unit of the sheet post-processing apparatus according to the example embodiment initially depicted in FIG. 2.

When the stapling operation is performed for two positions of the stack of paper sheets S, the first, second, and third rear end holding members 40*a* (which also is displaceable), 40*b*, and 40*c* of the rear end holding mechanism 40 may move as shown in FIGS. 6 and 7.

Specifically, after the stapling operation for the first position that is located in the vicinity of the second jogger fence 36*b* has been performed, the first rear end holding member 40*a* may recede to the opposite direction with respect to the staple tray 34, as shown in FIG. 6, so as to avoid an interference with the movement of the stapler 35. After the stapler 35 has reached at the next stapling position for the second position, the rear end holding member 40*a* may move to the direction toward the stack of paper sheets S to press and hold the rear end of the stack of paper sheets S, as shown in FIG. 7. Under the above-described condition, the stapler 35 may perform the stapling operation for the second position.

According to the at least one embodiment of the present invention, e.g., such as depicted in FIGS. 2-7, the sheet post-processing apparatus A can provide the following features.

The stapler 35 may move to and stand by at (or, in other words, is displaceable to) the position at which the stapler 35 avoids interfering with the respective pressing members 42 of the first, second, and third rear end holding members 40*a*, 40*b*, and 40*c* of the rear end holding mechanism 40, while the paper sheets S are being aligned. Thereby, the rear end holding mechanism 40 can effectively press and hold the rear end of the paper sheet S or of the stack of paper sheets S to be stapled.

The rear end holding mechanism 40 that are located at the rear end portion of the paper sheet S can flexibly move to the direction perpendicular to the sheet conveying direction.

Thereby, the rear end holding mechanism 40 can effectively correspond to various sizes of the paper sheet S.

The second and third rear end holding members 40*b* and 40*c* can move in a distance greater than the width of the given paper sheet S in the sheet width direction or the horizontal direction with respect to the width of the paper sheet S, which is the direction perpendicular to the sheet conveying direction. Thereby, the rear end holding mechanism 40 can correspond to various sizes of the stack of paper sheets S.

The degree or amount of pressure exerted by the rear end holding mechanism 40 may vary according to the thickness of the stack of paper sheets S. Thereby, an appropriate amount of pressure to press and hold the stack of paper sheets S may be provided even when the thickness of the stack of paper sheets S changes.

The controller of the sheet post-processing apparatus A may count the number of the paper sheets S stacked in the staple tray 34 so as to obtain the thickness of the stack of paper sheets S in the staple tray 34. Thereby, the mechanism of the sheet post-processing apparatus A can be simplified.

The elastically flexible member 43 can adjust the pressing distance of the rear end holding mechanism 40 to control the amount of pressure to the stack of paper sheets S exerted by the pressing member 42 by contracting to absorb the excess amount of pressure exerted by the pressing member 42 and by causing the pressing member 42 to recede to the direction opposite to the surface of the stack of paper sheets S and to the staple tray 34. Thereby, the excess amount of pressure to the stack of paper sheet S due to the variation in thickness of the stack of paper sheets S may be reduced or eliminated.

The elastically flexible member 43 may bias the pressure member 42. Thereby, the pressing member 42 can constantly press and hold the stack of paper sheets S.

The stapler 35 may perform the stapling operation while the pressing member 42 of each of the rear end holding mechanism 40 is pressing and holding the stack of paper sheets S. Thereby, the stack of paper sheets S can remain aligned during the stapling operation.

Referring to FIGS. 8 through 13, detailed states and functions of a staple unit 5' including two rear end holding mechanisms 40 and 49 of the sheet post-processing apparatus A' according to another example embodiment of the present invention are described.

FIGS. 8 through 13 are the structure of the staple unit 5' viewed from the direction indicated by arrow X in FIG. 1.

The structure of the staple unit 5' of the sheet post-processing apparatus A' depicted in FIGS. 8 through 13 may be similar to the structure thereof according to the example embodiment depicted in FIGS. 2 through 7. An exception is that the staple unit 5' further includes a rear end holding mechanism 49 that is mounted on the stapler 35 and is different from the rear end holding mechanism 40. Otherwise, the other structure, elements, and functions of the sheet post-processing apparatuses A' and A are generally identical. Therefore, the reference numbers and descriptions related thereto carryover and hence are not repeated for the sake of brevity.

As previously described, the stapler 35 shown in FIGS. 8 through 13 further includes the rear end holding mechanism 49, an elastically flexible member 48, and a pressing member 50.

Figure 8:
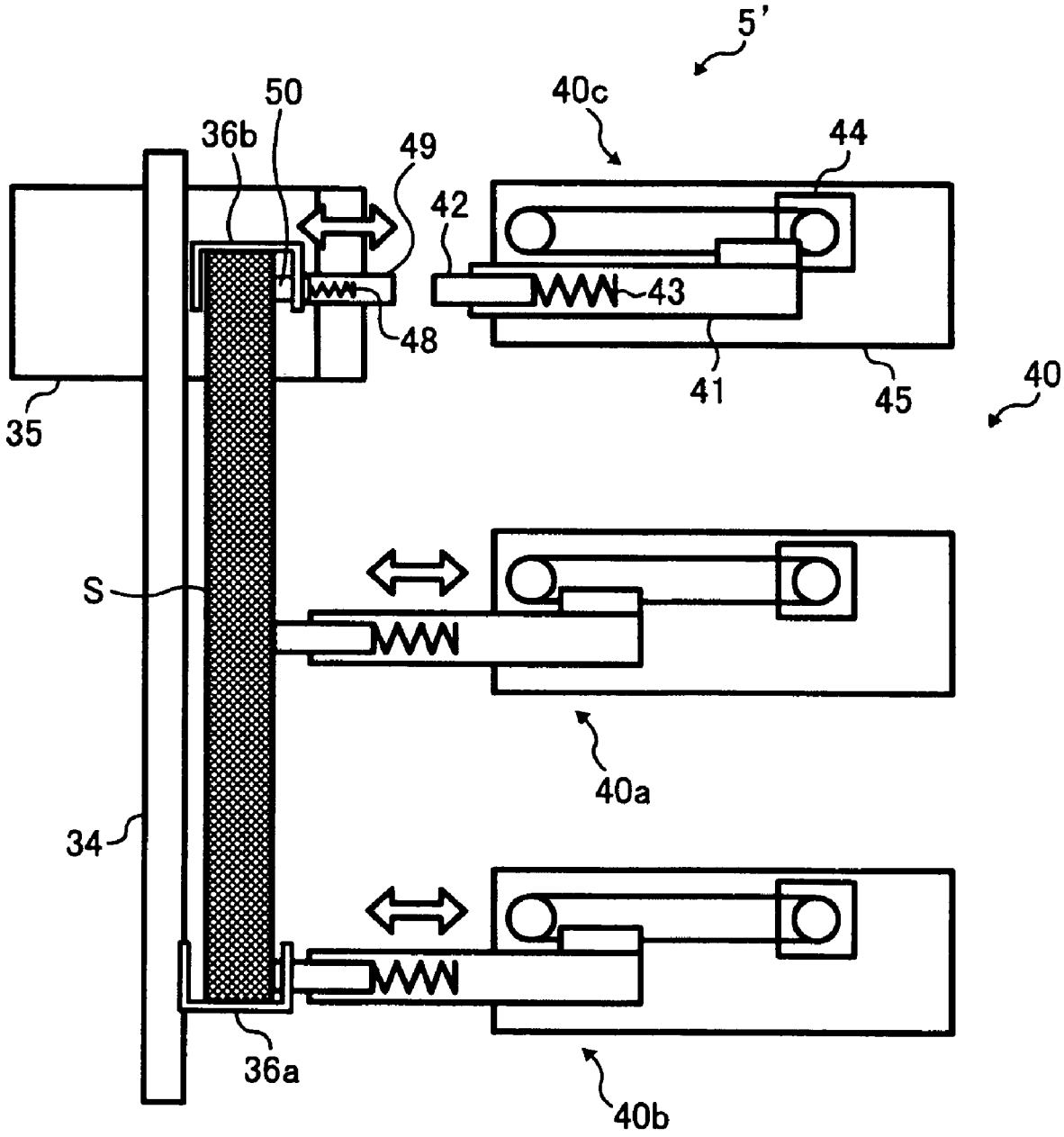
FIG. 8 is a schematic structure showing a state of the sheet alignment performed in the staple unit of the sheet post-processing apparatus according to an example embodiment of the present invention.

When the image forming apparatus B sends the staple mode signal to staple the stack of paper sheets S at its far side position, the stapler 35 and the first and second jogger fences 36*a* and 36*b* may move in the sheet width direction to the sheet receiving position and stand by at a given position as shown in FIG. 8.

As previously described, the paper sheet S may be aligned by the return roller 37 and the rear end fence 39 in the sheet conveying direction or the vertical direction and by the jogger fences 36 in the sheet width direction or the horizontal direction when the paper sheet S is conveyed to the staple tray 34.

After the sheet alignment of the paper sheet S has been completed, the incorrect status of the paper sheet S, such as sheet buckling, curl, or other nonconformity caused in the process of the sheet transfer into the staple tray 34, may be corrected or adjusted so that the next paper sheet S can easily fall in the rear end fence 39. Specifically, a motor (not show) may move the rear end holding mechanism 49 in synchronization with the movement of the first and second rear end holding members 40*a* and 40*b* driven by the motor 44, so that the rear end portion of the stack of paper sheets S can be pressed toward the staple tray 34.

During the above-described movement, the movement of the stapler 35 to the given position may cause interference between the pressing member 42 of the third rear end holding member 40*c* of the rear end holding mechanism 40 and the pressing member 50 of the rear end holding mechanism 49. To avoid the interference with the pressing member 50 of the rear end holding mechanism 49 mounted on the stapler 35, in that situation the third rear end holding member 40*c* may remain unmoved and the rear end holding mechanism 49 mounted on the stapler 35 may press and hold the rear end portion of the stack of paper sheets S.

When the next paper sheet S is conveyed to the staple tray 34, the pressing members 42 and 50 of the rear end holding mechanisms 40 and 49, respectively, may move away or recede from the rear end of the paper sheet S or of the stack of paper sheets S and return to the standby position, as shown in FIG. 8, so as to wait for a further subsequent paper sheet to come.

The controller of the sheet post-processing apparatus A' may count the number of the plurality of the paper sheets S stacked in the staple tray 34, and cause the motor 44 to adjust a travel distance to control a degree or amount of pressure exerted by the rear end holding mechanism 40 according to the obtained number of the paper sheets S.

Figure 9:
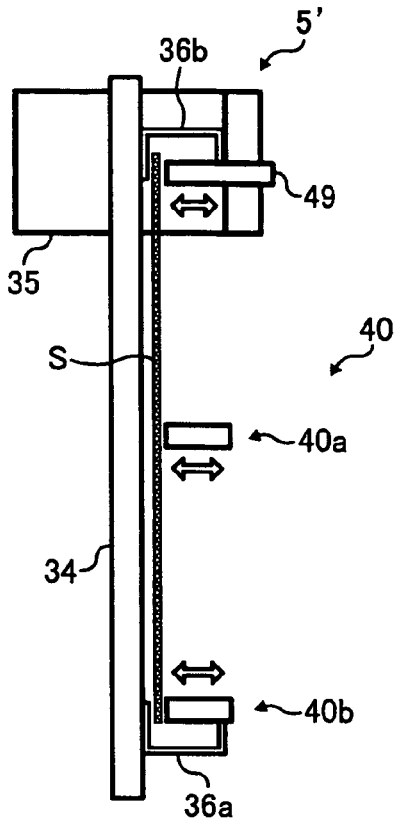
FIG. 9 is a schematic structure showing a different state of the sheet alignment performed in the staple unit of the sheet post-processing apparatus according to the example embodiment initially depicted in FIG. 8.

For example, when the number of the paper sheets S is small and the thickness of the stack of paper sheets S is thin, as shown in FIG. 9, the controller may cause the first and second rear end holding members 40*a* and 40*b* and the rear end holding mechanism 49 to adjust the travel distance to exert an appropriate small amount of pressure that may correspond to the stack of paper sheets S having the obtained number and thickness thereof. At this time, the third rear end holding member 40*c* may remain unmoved.

Figure 10:
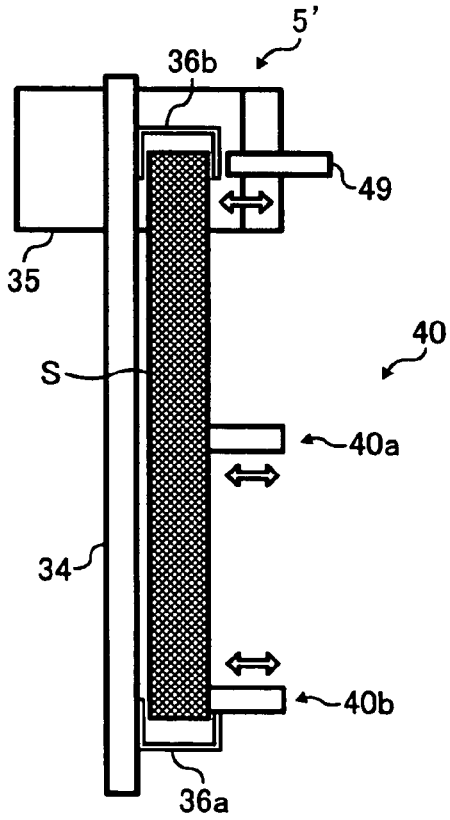
FIG. 10 is a schematic structure showing a different state of the sheet alignment performed in the staple unit of the sheet post-processing apparatus according to the example embodiment initially depicted in FIG. 8.

On the other hand, when the number of the plurality of the paper sheets S is great and the thickness of the stack of paper sheets S is thick, as shown in FIG. 10, the controller may cause the first and second rear end holding members 40*a* and 40*b* and the rear end holding mechanism 40 to adjust the travel distance to exert an appropriate large amount of pressure that may correspond to the stack of paper sheets S having the obtained number and thickness thereof.

With the above-described operation, the degree or amount of pressure may be kept at a constant level when the thickness of the stack of paper sheets S or the number of the plurality of the paper sheets S varies.

Further, when the thick paper sheets are processed, the controller may control the degree or amount of pressure exerted by each of the rear end holding mechanisms 40 and 49 such that an excess degree or amount of pressure may not be provided with respect to the stack of paper sheets S.

Specifically, each of the first, second, and third rear end holding members 40*a*, 40*b*, and 40*c* of the rear end holding mechanism 40 may have the elastically flexible member 43 mounted thereon to bias the pressing member 42, and the rear end holding mechanism 49 may also have the elastically flexible member 48 mounted thereon to bias the pressing member 50. When the pressing members 42 and 50 exert more than a desirable amount of pressure upon the stack of paper sheets S, the elastically flexible members 43 and 48 may adjust (or relieve) the amounts of pressure exerted by the pressing members 42 and 50. That is, when the pressing members 42 and 50 press the rear end portion of the stack of paper sheets S to provide an excess load to the stack of paper sheets S, the elastically flexible members 43 and 48 may contract (become compressed) to absorb the excess amount of pressure exerted by the pressing members 42 and 50. Thereby, the pressing members 42 and 50 may recede to the direction opposite to the surface of the stack of paper sheets S and the staple tray 34.

After the given number of the plurality of the paper sheets S have been aligned, while the rear end holding mechanisms 40 and 49 are pressing and holding the rear end portion of the stack of paper sheets S, the stapler 35 may move to the stapling position to perform the stapling operation.

When the stapler 35 staples the stack of paper sheets S at the near side position, the standby position of the stapler 35 may be set to a position in the vicinity of the first jogger fence 36*a*. Accordingly, the second rear end holding member 40*b* that is located in the vicinity of the stapler 35 this time may be moved to the direction opposite to the surface of the stack of paper sheets S and the staple tray 34 so as not to interfere with the stapler 35, and the stapler 35 may be moved to the stapling position to perform the stapling operation while the first and third rear end holding members 40*a* and 40*c* of the rear end holding mechanism 40 and the rear end holding mechanism 49 are pressing and holding the stapler 35.

Figure 11:
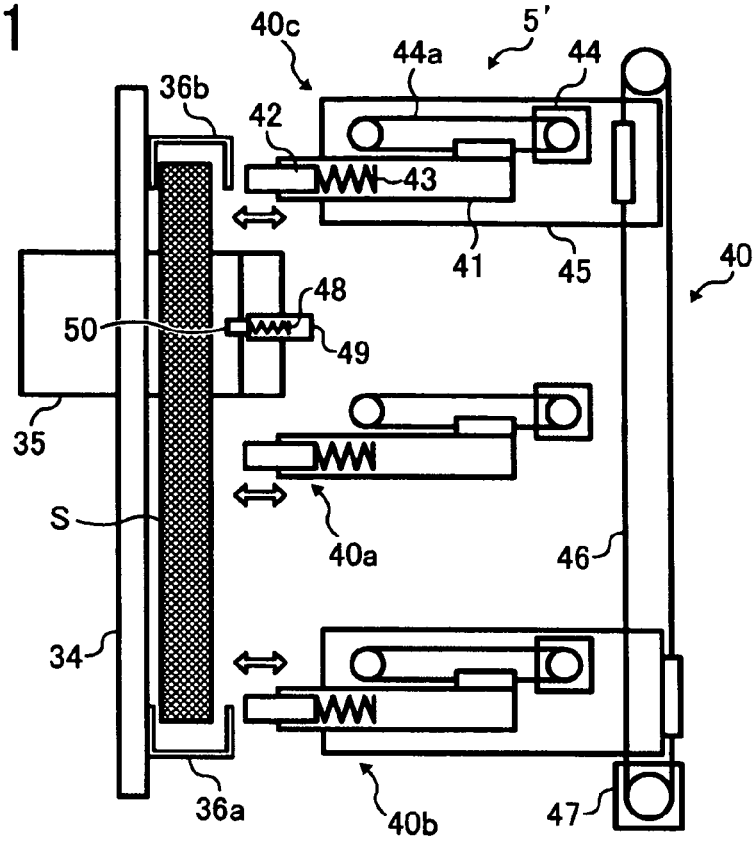
FIG. 11 is a schematic structure showing a different state of the sheet alignment performed in the staple unit of the sheet post-processing apparatus according to the example embodiment initially depicted in FIG. 8.
Figure 12:
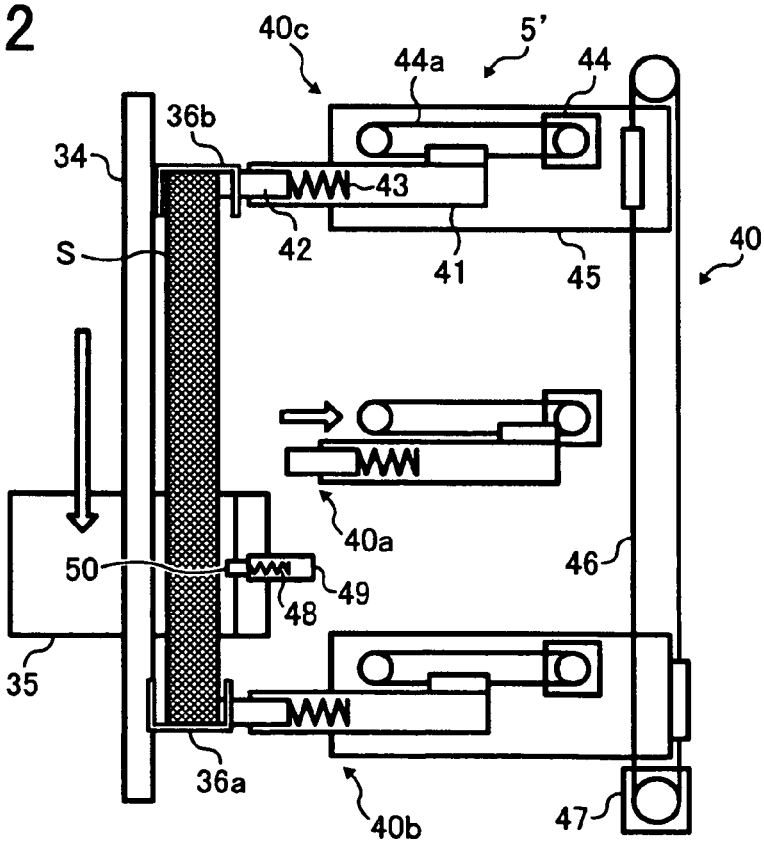
FIG. 12 is a schematic structure showing a different state of the sheet alignment performed in the staple unit of the sheet post-processing apparatus according to the example embodiment initially depicted in FIG. 8.

When the stapling operation is performed for two positions of the stack of paper sheets S, the first, second, and third rear end holding members 40*a*, 40*b*, and 40*c* of the rear end holding mechanism 40 may move and the rear end holding mechanism 49 may remain unmoved, as shown in FIGS. 11 and 12.

Figure 13:
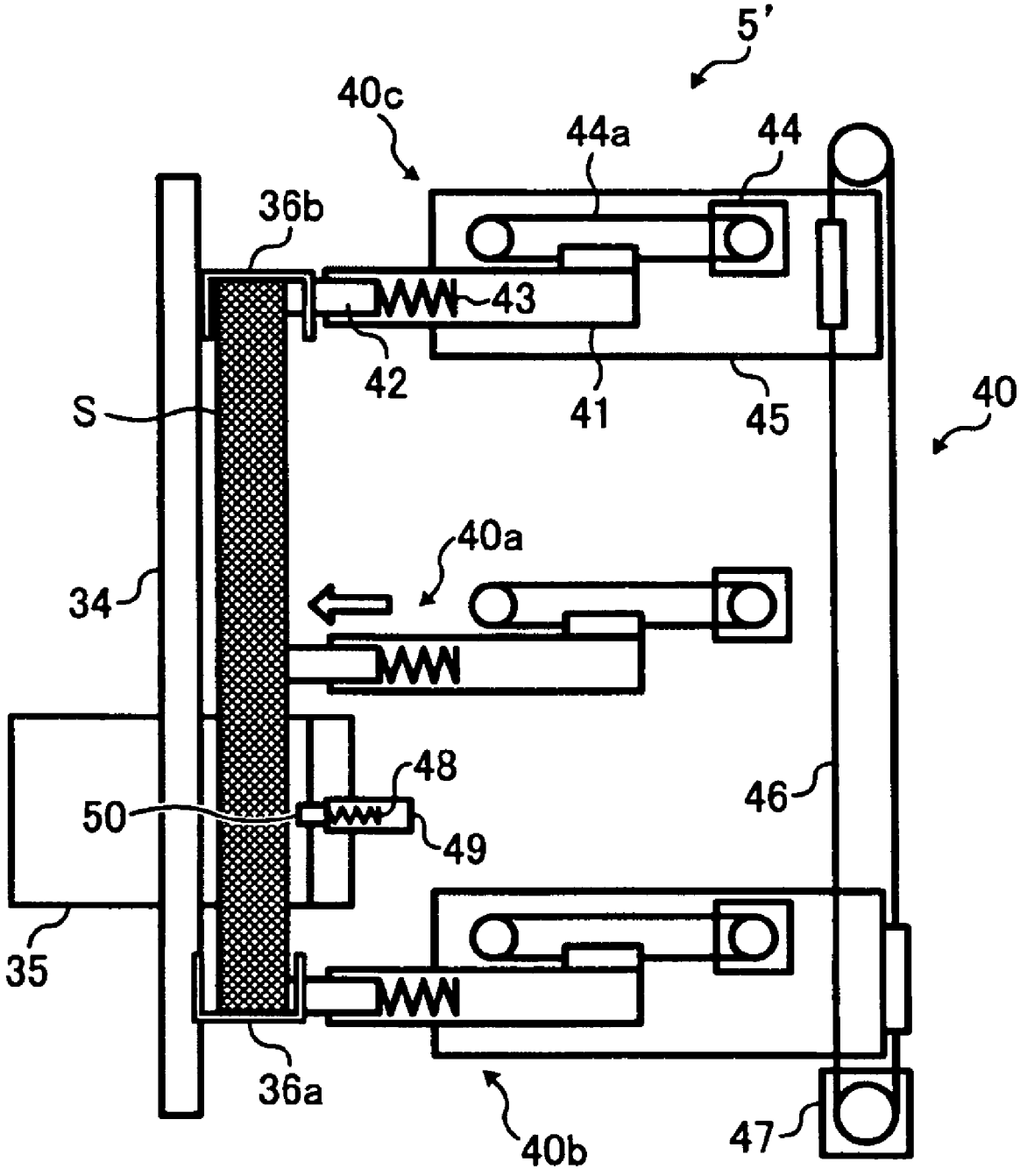
FIG. 13 is a schematic structure showing a different state of the sheet alignment performed in the staple unit of the sheet post-processing apparatus according to the example embodiment initially depicted in FIG. 8.

Specifically, after the stapling operation for the first position that is located in the vicinity of the second jogger fence 36*b* has been performed, the first rear end holding member 40*a* may recede to the opposite direction with respect to the staple tray 34, as shown in FIG. 11, so as to avoid an interference with the movement of the stapler 35. After the stapler 35 has reached at the next stapling position for the second position, the rear end holding member 40*a* may move to the direction toward the stack of paper sheets S to press and hold the rear end of the stack of paper sheets S, as shown in FIG. 13. Under the above-described condition, the stapler 35 may perform the stapling operation for the second position.

According to at least one example embodiment of the present invention, e.g., such as is depicted in FIGS. 8-13, the sheet post-processing apparatus A' can provide the following features.

The stapler 35 may include the rear end holding mechanism 49 mounted thereon. Thereby, the rear end holding mechanism 49 can effectively press and hold the rear end of the paper sheet S or of the stack of paper sheets S to be stapled.

With the rear end holding mechanism 40 including the first, second, and third rear end holding members 40*a*, 40*b*, and 40*c*, a plurality of positions on the rear end portion of the stack of paper sheets S can be pressed and held.

When the movement of the stapler 35 may cause an interference with the rear end holding mechanism 40, the pressing member 50 of the rear end holding mechanism 49 mounted on the stapler 35, e.g., may have priority over the corresponding pressing member 42 of the rear end holding mechanism 40. That is, the corresponding pressing member 42 of the rear end holding mechanism 40 may remain unmoved while the pressing member 50 of the rear end holding mechanism 49 may press and hold the stack of paper sheets S. Thereby, a collision of the rear end holding mechanism 40 and the stapler 35 can be avoided.

The degree or amount of pressure exerted by the rear end holding mechanism 49 may vary according to the thickness of the stack of paper sheets S. Thereby, an appropriate amounts of pressure to press and hold the stack of paper sheets S may be provided even when the thickness of the stack of paper sheets S changes.

The controller of the sheet post-processing apparatus A' may count the number of the paper sheets S stacked in the staple tray 34 so as to obtain the thickness of the stack of paper sheets S in the staple tray 34. Thereby, the mechanism of the sheet post-processing apparatus A' can be simplified.

The elastically flexible member 48 can adjust the pressing distance of the rear end holding mechanism 49 to control the amount of pressure to the stack of paper sheets S exerted by the pressing member 50 by contracting to absorb the excess amount of pressure exerted by the pressing member 50 and by causing the pressing member 50 to recede to the direction opposite to the surface of the stack of paper sheets S and to the staple tray 34. Thereby, the excess amount of pressure to the stack of paper sheet S due to the variation in thickness of the stack of paper sheets S may be reduced or eliminated.

The elastically flexible member 48 may bias the pressure member 50. Thereby, the pressing member 50 can constantly press and hold the stack of paper sheets S.

The stapler 35 may perform the stapling operation while the pressing member 50 of the rear end holding mechanism 49 is pressing and holding the stack of paper sheets S. Thereby, the stack of paper sheets S can remain aligned during the stapling operation.

The above-described example embodiments are illustrative, and numerous additional modifications and variations are possible in light of the above teachings. For example, elements and/or features of different example embodiments herein may be combined with each other and/or substituted for each other within the scope of this disclosure and appended claims. It is therefore to be understood that within the scope of the appended claims, the disclosure of this patent specification may be practiced otherwise than as specifically described herein.

What is claimed:

1. A sheet post-processing apparatus comprising:

a sheet stacking unit configured to stack a plurality of sheets of one or more printable media;

a sheet alignment unit configured to align the plurality of sheets stacked in the sheet stacking unit;

a first pressing member configured to press and hold the plurality of sheets stacked in the sheet stacking unit; and a stapling unit configured to staple the plurality of sheets aligned by the sheet alignment unit, the stapling unit being displaceable to a given position that avoids interference with the first pressing member while the sheet alignment unit performs a sheet alignment with respect to the plurality of sheets in the sheet stacking unit, wherein the first pressing member is further configured to move in a width direction of the plurality of sheets in the sheet stacking unit, the width direction being perpendicular to a sheet conveying direction.

2. The sheet post-processing apparatus according to claim 1, further comprising:

a moving unit configured to move the first pressing member in the width direction.

3. The sheet post-processing apparatus according to claim 2, wherein the moving unit is configured to move the first pressing member in a range greater than the width of the plurality of sheets in the sheet stacking unit.

4. The sheet post-processing apparatus according to claim 1, further comprising:

an adjusting unit configured to move in a direction perpendicular to the sheet conveying direction and to adjust an amount of pressure exerted by the first pressing member with respect to the plurality of sheets.

5. The sheet post-processing apparatus according to claim 4, wherein the adjusting unit is configured to control the amount of pressure according to a thickness of the plurality of sheets stacked in the sheet stacking unit.

6. The sheet post-processing apparatus according to claim 5, wherein the thickness of the plurality of sheets depends on a number of sheets included in the plurality of sheets stacked on the sheet stacking unit.

7. The sheet post-processing apparatus according to claim 6, wherein the adjusting unit includes an amount controlling member configured to move the first pressing member to a direction opposite to the plurality of sheets and the sheet stacking unit to control the amount of pressure.

8. The sheet post-processing apparatus according to claim 7, wherein the amount controlling member includes an elastically flexible material and is configured to contract to absorb an excess amount of pressure exerted by the first pressing member.

9. The sheet post-processing apparatus according to claim 1, wherein the stapling unit staples the plurality of sheets together while the first pressing member presses the plurality of sheets.

10. The sheet post-processing apparatus according to claim 1, further comprising:

a different first pressing member mounted on the stapling unit and different from the pressing mechanism disposed in the vicinity of the stapling unit.

11. A sheet post-processing apparatus comprising:

a sheet stacking unit configured to stack a plurality of sheets of one or more printable media;

a sheet alignment unit configured to align the plurality of sheets stacked in the sheet stacking unit;

a first pressing member configured to press and hold the plurality of sheets stacked in the sheet stacking unit;

a stapling unit configured to staple the plurality of sheets aligned by the sheet alignment unit; and a second pressing member different from the first pressing member and mounted on the stapling unit, wherein the first and second pressing members are further configured to move in a width direction of the plurality of sheets in the sheet stacking unit, the width direction being perpendicular to a sheet conveying direction.

12. The sheet post-processing apparatus according to claim 11, wherein when a movement of the stapling unit would cause interference between the first and second pressing members, the second pressing member presses and holds the plurality of sheets and a location of the first pressing member is selected such that the interference is avoided.

13. The sheet post-processing apparatus according to claim 11, further comprising:

an adjusting unit configured to move in a direction perpendicular to a sheet conveying direction and to adjust an amount of pressure exerted by the second pressing member with respect to the plurality of sheets.

14. The sheet post-processing apparatus according to claim 13, wherein the adjusting unit is configured to control the amount of pressure according to a thickness of the plurality of sheets stacked in the sheet stacking unit.

15. The sheet post-processing apparatus according to claim 14, wherein the thickness of the plurality of sheets depends on a number of sheets included in the plurality of sheets stacked on the sheet stacking unit.

16. The sheet post-processing apparatus according to claim 15, wherein the adjusting unit includes a relief member configured to move the second pressing member to a direction opposite to the plurality of sheets and the sheet stacking unit so as to relieve an excess amount of pressure.

17. The sheet post-processing apparatus according to claim 16, wherein the relief member includes an elastically flexible material and is configured to absorb via contraction the excess amount of pressure exerted by the second pressing member.

18. The sheet post-processing apparatus according to claim 11, wherein the stapling unit staples the plurality of sheets together while the second pressing member presses the plurality of sheets.

19. An image forming system comprising:

an image forming apparatus configured to form an image on a surface of a recording medium; and a sheet post-processing apparatus connected to the image forming apparatus, the sheet post-processing apparatus including the following, a sheet stacking unit configured to stack a plurality of sheets, a sheet alignment unit configured to align the plurality of sheets stacked in the sheet stacking unit, a first pressing member configured to press and hold the plurality of sheets stacked in the sheet stacking unit, and a stapling unit configured to staple the plurality of sheets aligned by the sheet alignment unit, the stapling unit being displaceable to a given position that avoids interference with the first pressing member while the sheet alignment unit performs a sheet alignment with respect to the plurality of sheets in the sheet stacking unit, wherein the first pressing member is further configured to move in a width direction of the plurality of sheets in the sheet stacking unit. the width direction being perpendicular to a sheet conveying direction.

20. The image forming system according to claim 19, further comprising:

a second pressing member mounted on the stapling unit and different from the first pressing member disposed in the vicinity of the stapling unit, wherein when a movement of the stapling unit would cause interference between the first and second pressing members, the second pressing mechanism mounted on the stapling unit presses and holds the plurality of sheets and a location of the first pressing member is selected such that the interference is avoided.

21. The sheet post-processing apparatus of claim 1, further comprising:

a belt connected to a motor; and a second pressing member configured to press and hold the plurality of sheets stacked in the sheet stacking unit and further configured to move in the width direction of the plurality of sheets in the sheet stacking unit, the width direction being perpendicular to the sheet conveying direction, wherein the first and second pressing members are configured to press the plurality of sheets in a direction perpendicular to the sheet width direction and perpendicular to the sheet aligning direction, and the first and second pressing members are connected to the belt so that the first and second pressing members simultaneously move towards or away from one another.

* * * * *